United States Patent [19]

Yamada et al.

[11] Patent Number: 5,026,622

[45] Date of Patent: Jun. 25, 1991

[54] SILVER HALIDE PHOTOGRAPHIC LIGHT-SENSITIVE MATERIAL RESTRAINED FROM PRODUCING PIN-HOLES

[75] Inventors: Taketoshi Yamada; Takeshi Habu, both of Tokyo, Japan

[73] Assignee: Konica Corporation, Tokyo, Japan

[21] Appl. No.: 427,479

[22] Filed: Oct. 27, 1989

[30] Foreign Application Priority Data

Oct. 31, 1988 [JP] Japan ..... 63-276556

[51] Int. Cl.[5] ..... G03C 1/06

[52] U.S. Cl. ..... 430/264; 430/527; 430/530; 430/536

[58] Field of Search ..... 430/264, 527, 530, 536

[56] References Cited

U.S. PATENT DOCUMENTS

| | | | |
|---|---|---|---|
| 4,418,141 | 11/1983 | Kawaguche et al. | 430/527 |
| 4,582,783 | 4/1986 | Nihel et al. | 430/527 |
| 4,585,730 | 4/1986 | Cho | 430/527 |
| 4,803,149 | 2/1989 | Takeshi et al. | 430/264 |
| 4,818,659 | 4/1989 | Takahashi et al. | 430/264 |

FOREIGN PATENT DOCUMENTS

| | | |
|---|---|---|
| 0219010 | 4/1987 | European Pat. Off. . |
| 2488700 | 2/1982 | France . |
| 60-122933 | 7/1985 | Japan . |
| 60-136739 | 7/1985 | Japan . |
| 2075208 | 11/1981 | United Kingdom . |

*Primary Examiner*—Charles L. Bowers, Jr.
*Assistant Examiner*—Thorl Chea
*Attorney, Agent, or Firm*—Finnegan, Henderson, Farabow, Garrett and Dunner

[57] ABSTRACT

A silver halide photographic light-sensitive material is disclosed, which is suitable for contact printing in photomechanical process and capable of being handled in day-light room. The light-sensitive material comprising a support; a silver halide emulsion layer being provided on a surface of the support and containing a tetrazolium compound or a hydrazine compound; a layer containing a tin oxide or an indium oxide and being provided on the surface of the support opposite to the surface the emulsion layer provided thereon; and a layer containing a homopolymer or a copolymer comprising sodium styrenesulfonate, and being provided directly or through an intermediate layer on the surface of the metal oxide containing layer further to the support. The light-sensitive material is excellent in reverse-text quality and inhibited in formation of pin-holes.

16 Claims, No Drawings

SILVER HALIDE PHOTOGRAPHIC LIGHT-SENSITIVE MATERIAL RESTRAINED FROM PRODUCING PIN-HOLES

FIELD OF THE INVENTION

The present invention relates to a silver halide photographic light-sensitive material which can be used under the circumstances so-called day-light room when using it in the field of graphic arts.

BACKGROUND OF THE INVENTION

In recent years, in the field of graphic arts, for the labor-saving, rationalization, and improvement of working conditions, a technology has been required to switch the conventional dark-room film-making, i.e., the so-called contact printing process, over to a day-light film making and, with those purposes, many improvements have been made on photographic light-sensitive materials and the equipments such as printers.

The photographic light-sensitive materials, which may be handled in day light room, include those photosensitive to light emitted from a light-source richly emitting UV rays, such as a ultra-high pressure mercury lamp, a metal halide light source, a xenon lamp, and a halogen lamp. These silver halide photographic light-sensitive materials can be handled under a normal fluorescent lamp as bright as 100 to 300 lux or a fluorescent lamp for exclusive use from which emits a small quantity of UV rays.

While these photographic light-sensitive materials have such advantages as mentioned above, they have such disadvantages as are liable to produce the so-called pin-hole trouble in blackened images got after they are developed.

The term, pin-hole, herein means a phenomenon that a white spot having a size of about 30 μm or smaller is produced in a blackened image. As the spot is in the circuler or amorphous shape and it looks as if it were made by piercing with a pin, so it has been named so.

From a film for contacting with a minute halftone dot image, any image reproduction fidelity cannot be got, if the film itself has abnormal images such as pin-holes in blackened areas. Therefore, the resulting pin-holes must be made cope with an opaque-treatment such as a spotting or image retouching work, so that the operation efficiency has been remarkably lowered.

From the view point of the above-described circumstances, there have been strong demands for a day-light processing film in which pin-holes can hardly be produced.

SUMMARY OF THE INVENTION

It is an object of the invention to provide a silver halide photographic light-sensitive material in which producing pin hole can be restrained when exposing the light-sensitive material to a selected light-source.

Another object of the invention is to provide a silver halide photographic light-sensitive material in which contacting characteristics for graphic arts use, such as quality of a reversed character image superposed on a halftone background, hereinafter called reverse text quality, are improved.

The above-described objects of the invention can be accomplished with a silver halide photographic light-sensitive material comprising a support, a silver halide emulsion layer being provided on a surface of the support and containing a tetrazolium compound or a hydrazine compound, a metal oxide-containing layer containing a tin oxide or an indium oxide and being provided on the surface of said support opposite to said surface on which the emulsion layer is provided, and a polymer-containing layer containing a homopolymer or a copolumer each comprising sodium styrenesulfonate, and being provided on the surface of said metal oxide-containing layer further to the support, provided that an intermediate layer may be interposed between the metal-oxide containing layer and the polymer-containing layer.

DETAILED DESCRIPTION OF THE INVENTION

The silver halide photographic light-sensitive materials applicable to the invention each contain a hydrazine compound or a tetrazolium compound.

The hydrazine compounds applicable to the invention include, preferably, the compounds represented by the following Formula I-a.

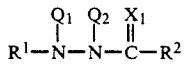

Formula I-a

In the formula, $R^1$ represents a univalent organic residual group: $R^2$ represents a hydrogen atom or a univalent organic residual group; $Q_1$ and $Q_2$ represent each a hydrogen atom, an alkylsulfonyl group including that having a substituent, or an arylsulfonyl group including that having a substituent; and $X_1$ represents an oxygen or sulfur atom. Among the compounds represented by Formula I, what is more preferable is the compounds in which $X_1$ is an oxygen atom and $R_2$ is a hydrogen atom.

The above mentioned univalent organic groups represented by $R^1$ and $R^2$ include, for example, aromatic, heterocyclic, and aliphatic groups.

Such aromatic groups include, for example, a phenyl group, and a naphthyl group and the substituents thereof such as an alkyl, alkoxy, acylhydrazino, dialkylamino, alkoxycarbonyl, cyano, carboxy, nitro, alkylthio, hydroxy, sulphonyl, or carbamoyl group, a halogen atom, an acylamino, sulfonamido, or thiourea group. As the actual examples of such aromatic groups each having a substituent include 4-methylphenyl group, 4-ethylphenyl group, 4-oxyethylphenyl group. 4-dodecylphenyl group, 4-carboxyphenyl group. 4-diethylaminophenyl group, 4-octylaminophenyl group, 4-benzylaminophenyl group, 4-acetamido-2-methylphenyl group, 4-(3-ethylthioureido)phenyl group, and 4-[2-(2,4-di-tert-butylphenoxy)butylamido)phenyl group. The hetrocyclic groups include, for example, 5- or 6-membered single or condensed rings containing at least one of oxygen. nitrogen, sulfur and selenium atoms. Each of these rings may also have a substituent. Typically, such heterocyclic groups include those having a ring of pyrroline, pyridine, quinoline, indole, oxazole, benzoxazole, naphthoxazole, imidazole, benzoimidazole, thiazoline, thiazole, benzothiazole, naphthothiazole, selenazole, benzoselenazole, and naphthoselenazole.

These heterocyclic rings may be substituted with an alkyl group having 1 to 4 carbon atoms such as a methyl or ethyl group, an alkoxy group having 1 to 4 carbon atoms such as a methoxy or ethoxy group, an aryl group having 6 to 18 carbon atoms such as a phenyl group, a halogen atom such as chlorine or bromine atom, an alkoxycarbonyl group, a cyano group, or an amino group.

The aliphatic groups include, for example, a straight- or branch-chained alkyl or cycloalkyl group, each of those having a substituent, an alkenyl group, and an alkinyl group.

The straight- and branch-chained alkyl groups include, for example, those having 1 to 18 carbon atoms and, preferably, those having 1 to 8 carbon atoms. They include, typically, a methyl group, an ethyl group, an isobutyl group, and a 1-octyl group.

The cycloalkyl groups include, for example, those having 3 to 10 carbon atoms and, typically, a cyclopropyl group, a cyclohexyl group, and an adamantyl group. The substituents to such alkyl and cycloalkyl groups include, for example, alkoxy groups such as a methoxy group, an ethoxy group, a propoxy group, and a butoxy group, an alkoxycarbonyl group, a carbamoyl group, a hydroxy group, an alkylthio group, an amido group, a siloxy group, a cyano group, a sulfonyl group, halogen atoms such as a chlorine atom, a bromine atom, and a fluorine atom and an iodine atom, and aryl groups such as a phenyl group, a halogen-substituted phenyl group, and an alkyl-substituted phenyl group. The typical examples of the substituents having a substituent include a 3-methoxypropyl group, an ethoxycarbonylmethyl group, 4-chlorocyclohexyl group, a benzyl group, a p-metylbenzyl group, and a p-chlorobenzyl group. Further, the alkenyl groups include an allyl group, and the alkinyl groups include a propargyl group.

The preferable examples of the hydrazine compounds will be given hereunder. It is, however, to be understood that the present invention shall not be limited thereto.

(I- 1) 1-formyl-2-{4-[2-(2,4-di-tert-butylphenoxy)-butylamido]phenyl)}hydrazine (I- 2) 1-formyl-2-(4-diethylaminophenyl)hydrazine (I- 3) 1-formyl-2-(p-toryl)hydrazine (I- 4) 1-formyl-2-(4-ethylphenyl)hydrazine (I- 5) 1-formyl-2-(4-acetamido-2-methylphenyl)hydrazine (I- 6) 1-formyl-2-(4-oxyethylphenyl)hydrazine (I- 7) 1-formyl-2-(4-N,N-dihydroxyethylaminophenyl)-hydrazine (I- 8) 1-formyl-2-[4-(3-ethylthioureido)phenyl]hydrazine (I- 9) 1-thioformyl-2-{4-[2-(2,4-di-tert-butylphenoxy)-butylamido]phenyl}hydrazine (I-10) 1-formyl-2-(4-benzylaminophenyl)hydrazine (I-11) 1-formyl-2-(4-octylaminophenyl)hydrazine (I-12) 1-formyl-2-(4-dodecylphenyl)hydrazine (I-13) 1-acetyl-2-{4-2-2,4-di-tert-butylphenoxy)-butylamido)phenyl}hydrazine (I-14) 4-carboxyphenylhydrazine (I-15) 1-acetyl-1-(4-methylphenylsulfonyl)-2-phenylhydrazine (I-16) 1-ethoxycarbonyl-1-(4-methylphenylsulfonyl)-2-phenylhydrazine (I-17) 1-formyl-2-(4-hydroxyphenyl)-2-(4-methylphenylsulfonyl)-hydrazine (I-18) 1-(4-acetoxyphenyl)-2-formyl-1-(4-methylphenylsulfonyl)-hydrazine (I-19) 1-formyl-2-(4-hexanoxyphenyl)-2-(4-methylphenylsulfonyl)-hydrazine (I-20) 1-formyl-2-[4-(tetrahydro-2H-pyrane-2-yloxy)-phenyl]-2-(4-methylphenylsulfonyl)-hydrazine (I-21) 1-formyl-2-[4-(3-hexylureidophenyl)]-2-(4-methylphenylsulfonyl)-hydrazine (I-22) 1-formyl-2-(4-methylphenylsulfonyl)-2-[4-(phenoxythiocarbonylamino)-phenyl]-hydrazine (I-23) 1-(4-ethoxythiocarbonylaminophenyl)-2-formyl-1-(4-metylphenylsulfonyl)-hydrazine (I-24) 1-formyl-2-(4-methylphenylsulfonyl)-2-[4-(3-methyl-3-phenyl-2-thioureido)-phenyl]-hydrazine (I-25) 1-{{4-{3-[4-(2,4-bis-t-amylphenoxy)-butyl]-ureido}-phenyl}}-2-formyl-1-(4-methylphenylsulfonyl)-hydrazine

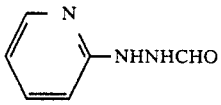

(I-26)

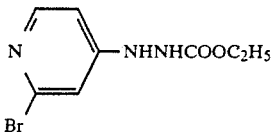

(I-27)

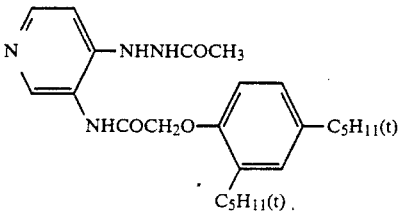

(I-28)

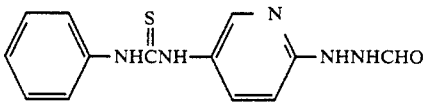

(I-29)

-continued
(I-30)
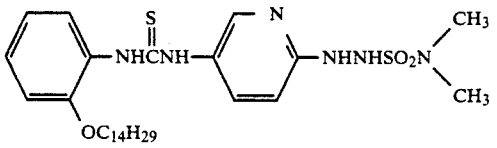
(I-31)
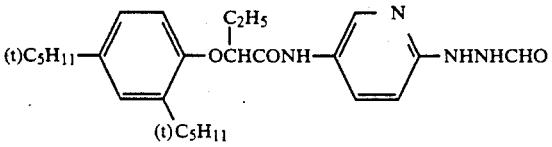
(I-32)
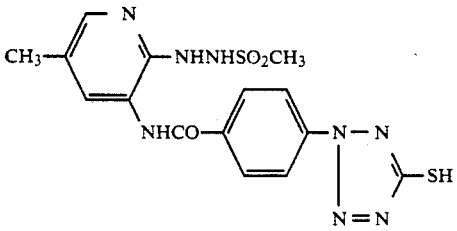
(I-33)
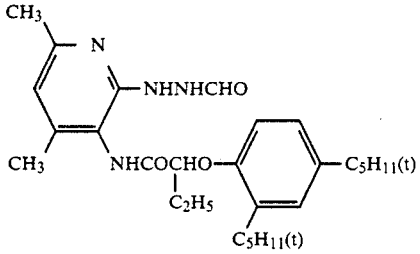
(I-34)
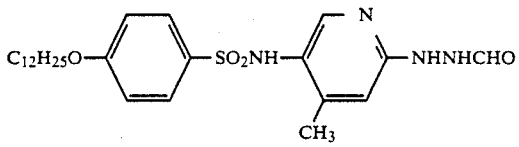
(I-35)
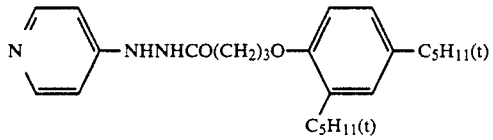
(I-36)
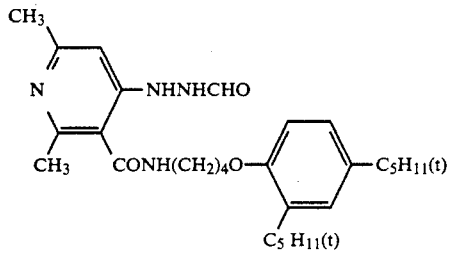
(I-37)
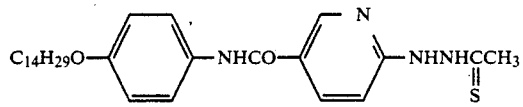
(I-38)
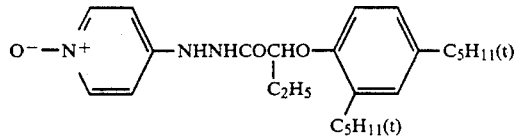

-continued
(I-39)
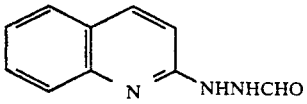
(I-40)
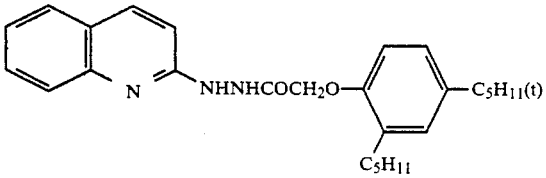
(I-41)
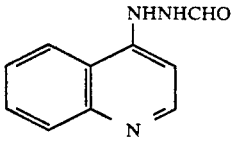
(I-42)
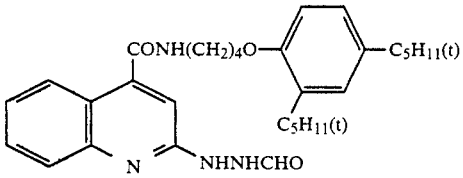
(I-43)
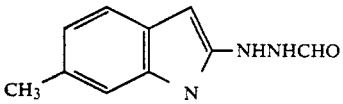
(I-44)
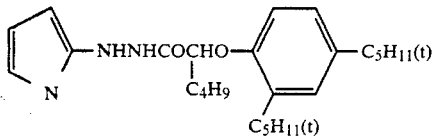
(I-45)
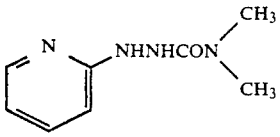
(I-46)
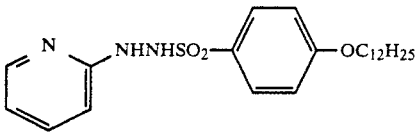
(I-47)
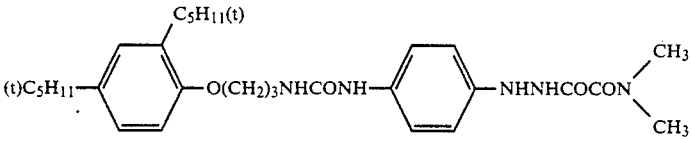
(I-48)
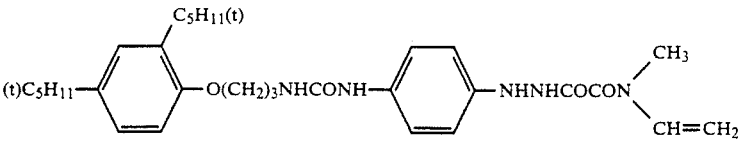

-continued
(I-49)
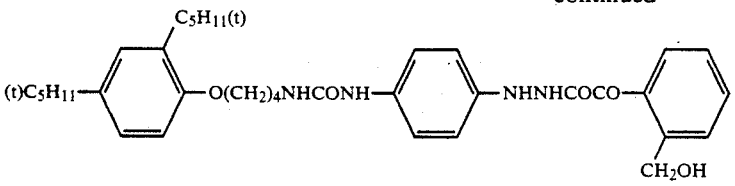
(I-50)
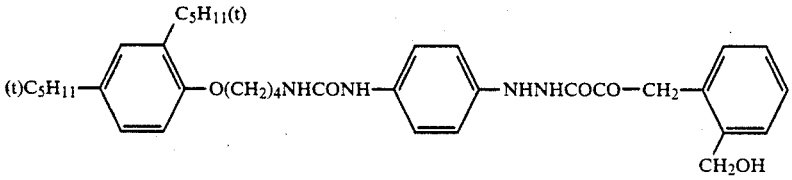
(I-51)
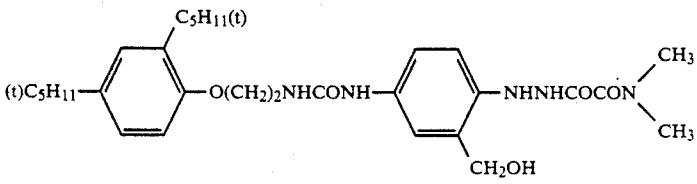
(I-52)
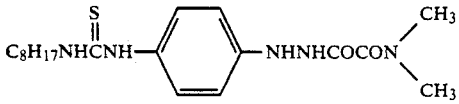
(I-53)
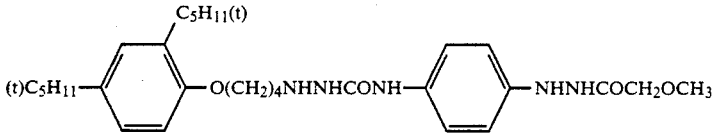
(I-54)
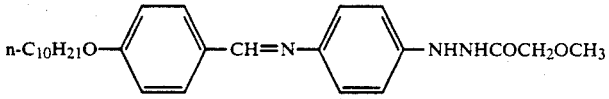
(I-55)
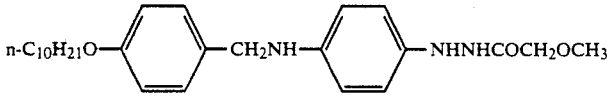
(I-56)
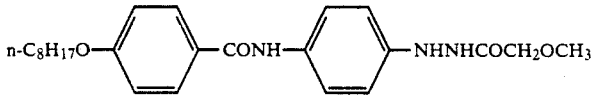
(I-57)
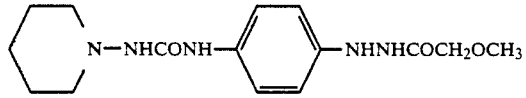
(I-58)
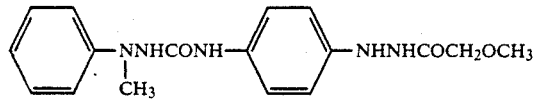
(I-59)
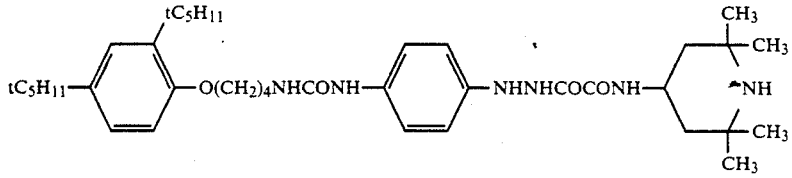
The hydrazine compound represented by Formula I-a is to be added to a silver halide emulsion layer, although it further may be added to a non-sensitive layer arranged onto the silver halide emulsion layer side of the support and, preferably, onto the layer arranged under the emulsion layer. They are to be added in an amount within the range of, preferably, $10^{-5}$ to $10^{-1}$ mol per mol of silver and, more preferably, $10^{-4}$ to $10^{-2}$ mol per mol of silver.

Now, the tetrazolium compounds applicable to the present invention will be detailed.

Such tetrazolium compounds can be represented by the following Formula I-b, I-c, or I-d.

Formula I-b

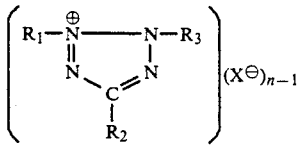

Formula I-c

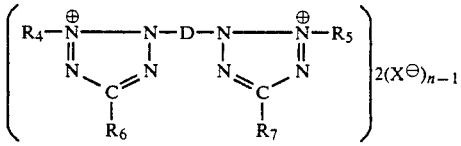

Formula I-d

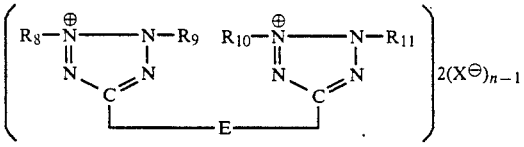

Wherein $R_1$, $R_3$, $R_4$, $R_5$, $R_8$, $R_9$, $R_{10}$ and $R_{11}$ each are a alkyl groups such as a methyl group, an ethyl group, a propyl group and a dodecyl group; alkenyl groups such as a vinyl group, an allyl group, and a propenyl group; aryl groups such as a phenyl group, a tolyl group, a hydroxyphenyl group, a carboxyphenyl group, an aminophenyl group, a mercaptophenyl group, an $\alpha$-naphthyl group, a $\beta$-naphthyl group, a hydroxynaphthyl group, a carboxynaphthyl group, and an aminonaphthyl group; and heterocyclic groups such as a thiazolyl group, a benzothiazolyl group, an oxazolyl group, a pyrimidinyl group or a pyridyl group. The above mentioned groups allowed to have a substituent. They may also be such groups as are capable of forming a metal chelate or complex.

$R_2$, $R_6$ and $R_7$ and are each an allyl groups, phenyl groups; naphthyl groups: heterocyclic groups, alkyl groups such as a methyl group, an ethyl group, a propyl group, a butyl group, a mercaptomethyl group, and a mercaptoethyl group, hydroxyl groups; carboxyl groups and the salts thereof: alkoxycarbonyl groups such as a methoxycarbonyl group and an ethoxycarbonyl group: amino groups such as an amino group, an ethylamino group, and an anilino group; mercapto groups: nitro groups or a hydrogen atom. Each of the above-mentioned groups may have a substituent. D is a 2- valent aromatic group E is an alkylene groups, allylene groups or aralkylene groups. $X^{\ominus}$ is anion. n is an integral number of one or two, provided when the compound forms an intramolecular salt, n is one. Now, the actual examples of tetrazolium compounds represented by the foregoing Formula I-b, I-c or I-d will be given below. However, the present invention shall not be limited to them only.

(1) 2-(benzothiazole-2-yl)-3-phenyl-5-dodecyl-2H-tetrazolium
(2) 2,3-diphenyl-5-(4-t-octyloxyphenyl)-2H-tetrazolium
(3) 2,3,5-triphenyl-2H-tetrazolium
(4) 2,3,5-tri(p-carboxyethylphenyl)-2H-tetrazolium
(5) 2-(benzothiazole-2-yl)-3-phenyl-5-(o-chlorophenyl)-2H-tetrazolium
(6) 2,3-diphenyl-2H-tetrazolium
(7) 2,3-diphenyl-5-methyl-2H-tetrazolium
(8) 3-(p-hydroxyphenyl)-5-methyl-2-phenyl-2H-tetrazolium
(9) 2,3-diphenyl-5-ethyl-2H-tetrazolium
(10) 2,3-diphenyl-5-n-hexyl-2H-tetrazolium
(11) 5-cyano-2,3-diphenyl-2H-tetrazolium
(12) 2-(benzothiazole-2-yl)-5-phenyl-3-(4-tolyl)-2H-tetrazolium
(13) 2-(benzothiazole-2-yl)-5-(4-chlorophenyl)-3-(4-nitrophenyl)-2H-tetrazolium
(14) 5-ethoxycarbonyl-2,3-di(3-nitrophenyl)-2H-tetrazolium
(15) 5-acetyl-2,3-di(p-ethoxyphenyl)-2H-tetrazolium
(16) 2,5-diphenyl-3-(p-tolyl)-2H-tetrazolium
(17) 2,5-diphenyl-3-(p-iodophenyl)-2H-tetrazolium
(18) 2,3-diphenyl-5-(p-diphenyl)-2H-tetrazolium
(19) 5-(p-bromophenyl)-2-phenyl-3-(2,4,6-trichlorophenyl)-2H-tetrazolium
(20) 3-(p-hydroxyphenyl)-5-(p-nitrophenyl)-2-phenyl2H-tetrazolium
(21) 5-(3,4-dimethoxyphenyl)-3-(2-ethoxyphenyl)-2-(4-methoxyphenyl)-2H-tetrazolium
(22) 5-(4-cyanophenyl)-2,3-diphenyl-2H-tetrazolium
(23) 3-(p-acetamidophenyl)-2,5-diphenyl-2H-tetrazolium
(24) 5-acetyl-2,3-diphenyl-2H-tetrazolium
(25) 5-(fran-2-yl)-2,3-diphenyl-2H-tetrazolium
(26) 5-(thiophene-2-yl)-2,3-diphenyl-2H-tetrazolium
(27) 2,3-diphenyl-5-(pyrid-4-yl)-2H-tetrazolium
(28) 2,3-diphenyl-5-(quinol-2-yl)-2H-tetrazolium
(29) 2,3-diphenyl-5-(benzoxyazol-2-yl)-2H-tetrazolium
(30) 2,3,5-tri(p-ethylphenyl)-2H-tetrazolium
(31) 2,3,5-tri(p-allylphenyl)-2H-tetrazolium
(32) 2,3,5-tri(p-hydroxyethyloxyethoxyphenyl)-2H-tetrazolium
(33) 2,3,5-tri(p-dodecylphenyl)-2H-tetrazolium
(34) 2,3,5-tri(p-benzylphenyl)-2H-tetrazolium Thes anion portions represented by $X^{\ominus}$ denoted in the above-given Formula I-b or I-c include halogen ions such as $Cl^{\ominus}$.

The tetrazolium compounds applicable to the invention may be used independently or in combination in any desired proportions.

In one of the embodiments of the invention, such tetrazolium compound relating to the invention is added into a silver halide emulsion layer. Besides, in another preferable embodiment of the invention, it may be further added into a non-light-sensitive hydrophilic colloidal layer directly adjoining to the silver halide emulsion layer or a non-light-sensitive hydrophilic colloidal layer which is adjoining to silver halide emulsion layer with the interposition of an interlayer therebetween.

In a further embodiment of the invention, such tetrazolium compounds relating to the invention may be further added into a light-sensitive material in such a manner that the tetrazolium compound is dissolved in a suitable organic solvents including, for example, alcohols such as methanol or ethanol, ethers, or esters; and the resulting solution is coated in, for example, an overcoat method, directly to the outermost layer on the silver halide emulsion layer side of the light-sensitive material.

The tetrazolium compounds relating to the invention may be used in an amount within the range of, preferably. $1\times10^{-6}$ to 10 mols per mol of silver halides contained in a light-sensitive material of the invention and, more preferably, $2\times10^{-4}$ to $2\times10^{-1}$ mol.

In a embodiment of the invention, a silver halide emulsion layer containing a tetrazolium compound or a hydrazine compound is provided on a surface of a support, and, on another surface of the support, a layer containing a metal oxide is provided, and a layer containing a homopolymer or copolymer comprised of sodium styrenesulfonate is further provided on the metal oxide-containing layer with or without an intermediate layer interposed between these layers.

As the metal oxides of the invention, indium oxide, tin oxide, or one of these metal oxide doped with antimony or phosphorus atom, or the combination thereof may be used. Preferable coating amount of the metal oxides is 0.01 to 10 g/m$^2$, more preferably 0.1 to 1 g/m$^2$.

Such indium oxides include indous oxide $In_2O$ and indic oxide $In_2O_3$ each having been known. Among them, indic oxide is preferably used in the invention.

Such tin oxides include stannous oxide SnO and stannic oxide $SnO_2$ each having been known. Among them, stannic oxide is preferably used in the invention.

Such metal oxides, with which an antimony or phosphorus atom is doped, include typically tin oxide and indium oxide. The metal oxides may be doped with an antimony or phosphorus atom in such a manner that a halide, alkoxide, or nitrate compound of tin or indium is mixed with a halide, alkoxide. or nitrate compound of antimony or phosphorus, and the resulting mixture is so baked as to be oxidized. These metal compounds are readily available from such a metal compound manufacturer as Japan Yttrium Company. A content of antimony or indium to be doped with is preferably within the range of 0.5 to 10% by weight to an amount of tin or indium used. These metal oxides may be added preferably by dispersing them in a hydrophilic colloid such as gelatin, or in a macromolecular compound such as a polymer comprising acrylic acid or maleic acid. A proportion of these compounds to be carried in is preferably within the range of 1 to 100% by weight per binder used.

Next, homo- and copolymers comprising sodium styrenesulfonate, hereinafter referred to polymer of the invention, are characterized in having a molecular weight within the range of 1000 to one million and more preferably 5,000 to one million and a component of

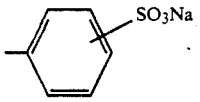

in the polymer chain thereof, and other component structure may also be used in combination.

Such polymers may readily be synthesized by polymerizing monomers each available on the market or prepared in any ordinary methods.

Now, the typical examples of such compounds will be given below.

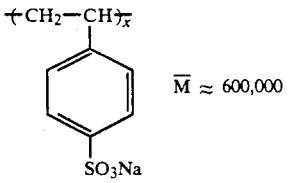

$\overline{M} \approx 600{,}000$

II-2

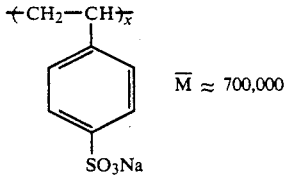

$\overline{M} \approx 700{,}000$

II-3

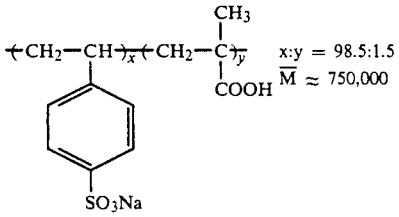

x:y = 98.5:1.5
$\overline{M} \approx 750{,}000$

III-4

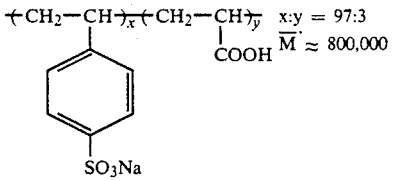

x:y = 97:3
$\overline{M} \approx 800{,}000$

II-5

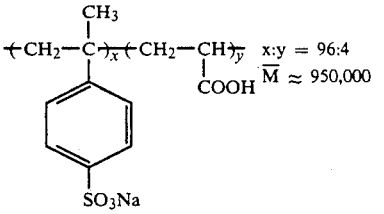

x:y = 96:4
$\overline{M} \approx 950{,}000$

II-6

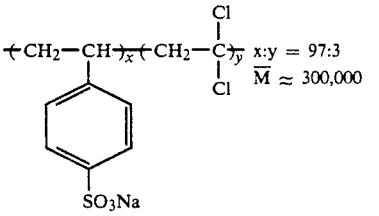

x:y = 97:3
$\overline{M} \approx 300{,}000$

II-7

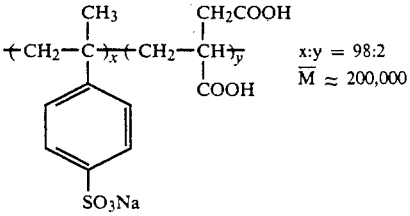

x:y = 98:2
$\overline{M} \approx 200{,}000$

-continued

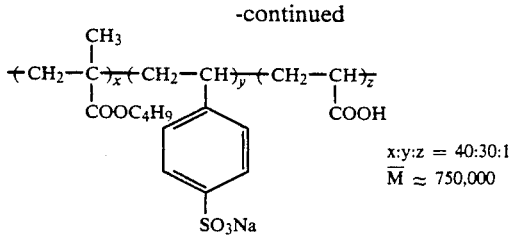

II-8 x:y:z = 40:30:1

$\overline{M} \approx 750,000$

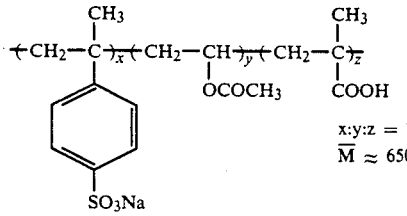

II-9 x:y:z = 70:28:2

$\overline{M} \approx 650,000$

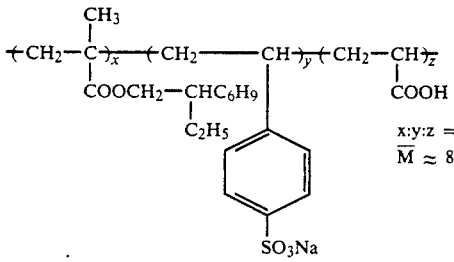

II-10 x:y:z = 85:13:2

$\overline{M} \approx 800,000$

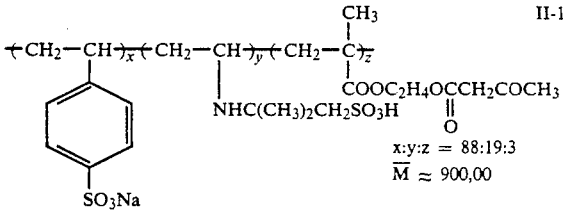

II-11 x:y:z = 88:19:3

$\overline{M} \approx 900,00$

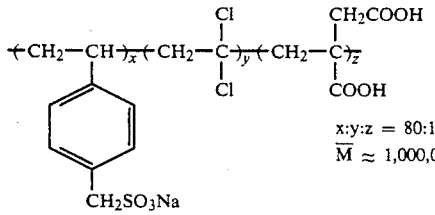

II-12 x:y:z = 80:16:4

$\overline{M} \approx 1,000,000$

In the above-given II-1 through II-12, x, y, and z each represent a mol% of the monomer component thereof; and $\overline{M}$ represents an average molecular weight which herein means a quantitative average molecular weight.

A polymer content of a silver halide photographic light-sensitive material of the invention is within the range of, preferably, 0.1 to 10 g per $m^2$ unit and, particularly, 0.2 to 5 g in terms of solid component.

Silver halides applicable to the silver halide photographic light-sensitive materials relating to the invention include, for example, silver chloride, silver chlorobromide, and silver chloroiodobromide each having any composition. It is, however, preferable that they contain at least 50 mol % of silver chloride. Silver halide grains have an average grain-size within the range of, preferably, 0.025 to 0.5 μm and, more preferably, 0.05 to 0.30 μm.

The monodispersion degrees of the silver halide grains relating to the invention which are defined below, are preferably within the range of 5 to 60 and, more preferably. 8 to 30.

A size of a silver halide grain is expressed by an edge-length of a cubic crystal grain, and a monodispersion degree is expressed by a numeral value 100 times as much as a value obtained by divising the standard deviation of a grain size distribution by an average grain size.

As the silver halides applicable to the invention, those of the type of at least two-layered core/shell structure may preferably be used. For example, they may also be silver chlorobromide grains each comprising the cores containing silver chloride and the shells containing silver bromide and, contrarily, the core containing silver bromide and the shall containing silver chloride. In these cases, an iodide may be added in an amount of not more than 5 mol % into any desired layers.

It is also allowed to use at least two kinds of grains mixed together. It is allowed, for example, to use mixed grains comprising cubic, octahedral or tabular silver chloroiodobromide grains having a silver chloride content of not more than 10 mol % and an iodide content of not more than 5 mol % to serve as the main grains and cubic, octahedral or tabular silver chloroiodobromide grains having an iodide content of not more than 5 mol % and a silver chloride content of not less than 50 mol % to serve as the secondry grains thereof. In such a case of using a mixture of grains as described above, such main and secondry grains may be chemically sensitized in any manner. However, the sensitivity of the secondry grains may be lowered than that of the main grains either by moderating the chemically sensitization or by adjusting the grain-size or an amount of noble metal such as rhodium which is to be doped inside the grains. It is further allowed to fog the inside of the grains either with the use of gold or by changing the core/shell composition into the other in a core/shell method. Both of the main and secondry grains are the smaller, the better. They may have any grain-size within the range of 0.025 to 1.0 μm.

When preparing a silver halide emulsion applicable to the invention, the sensitivity or contrast of the emulsion may be controlled by adding a rhodium salt. It is generally preferable to add such rhodium salt when silver halide grains are produced. However, the addition of the same may also be made in the course of a chemical ripening, or the preparation of an emulsion-coating solution.

Such rhodium salts to be added to the silver halide emulsions applicable to the invention may be those of simple salts and, besides, those of double salts, which include, typically, rhodium trichloride, and ammonium hexachloridorhodate.

An amount of the rhodium salts to be added may freely be changed depending on a sensitivity or contrast required and, more usefully, in an amount within the range of $10^{-9}$ to $10^{-4}$ mols per mol of silver used.

When using the rhodium salts, it is also allowed to use, in combination, other inorganic compounds such as a salt of iridium, platinum, thallium, cobalt, or gold. Such iridium are often preferably used in an amount within the range of $10^{-9}$ to $10^{-4}$ mols per mol of silver used, for the purpose of improving the high-intensity exposure characteristics of an emulsion to be prepared.

The silver halide emulsions applicable to the invention may be sensitized with a variety of chemical sensitizers including, for example, active gelatin, sulfur-sensitizers such as sodium thiosulfate, allylthiocarbamide, thiourea, and allylisocyanate: selenium-sensitizers such as N,N-dimethylselenourea, and selenourea; reductionsensitizers such as triethylenetetramine, and stannous chloride, and a variety of noble-metal sensitizers typically including, for example, potassium chloroaurite, potassium aurithiocyanate, potassium chloroaurate, 2-aurosulfobenzothiazole methyl chloride, ammonium chloropalladate, potassium chloroplatinate, and sodium chloropalladite. They may be used independently or in combination. When using a gold sensitizer, ammonium thiocyanate may be used together as an assistant.

The advantages of the invention may be more enhanced when a desensitizing dye and/or a UV absorbent are added into a silver halide photographic light-sensitive material relating to the invention.

The preferably applicable desensitizing dyes include those represented by the following Formulas III-a through III-e.

The preferably applicable UV absorbers include those represented by the following Formulas III-f and III-g.

Those compounds may be synthesized with reference to the patent specifications of U.S. Pat. Nos. 3,567,456, 3,615,639, 3,579,345, 3,615,608, 3,598,598, 3,598,955, 3,592,653, and 3,582,343; and Japanese Patent Examined Publication Nos. 40-26751(1965), 40-27332(1965), 43-13167(1968), 45-8833(1970), and 47-8746(1972), for example.

Formula III-a

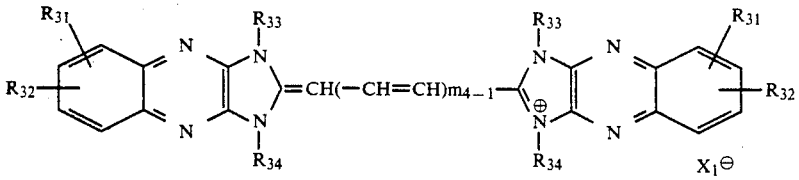

Formula III-b

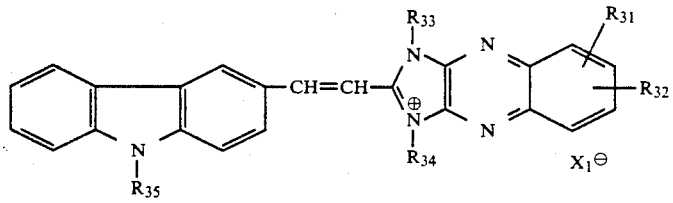

wherein $R_{31}$ and $R_{32}$ represent each a hydrogen atom, a halogen atom, a cyano group, or a nitro group, provided, $R_{31}$ and $R_{32}$ together may form an aromatic ring; $R_{33}$ and $R_{34}$ represent each an alkyl group, a lower alkenyl group, a phenyl group, or a lower hydroxyalkyl group; $m_4$ is a positive integer of 1 to 4; $R_{35}$ represents a lower alkyl group, or a sulfonated lower alkyl group; and $X_1$ represents an acid anioun.

Formula III-c

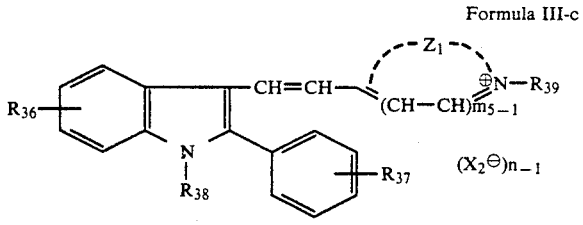

wherein $R_{36}$ and $R_{37}$ represent each a hydrogen atom, or a nitro group: $R_{38}$ and $R_{39}$ represent each a lower alkyl group, atoms necessary to complete a nitrobenzothiazole nucleus, a nitrobenzooxazole nucleus, a nitrobenzoselenazole nucleus, an imidazo[4,5-b]quinooxaline nucleus, a 3.3-dimethyl-3H-pyrrolo[2.3-b]pyridine nucleus, a 3.3-dialkyl-3H-nitroindole nucleus, a thiazolo[4.5-b]quinoline nucleus, a nitroquinoline nucleus, a nitrothiazole nucleus, a nitronaphthothiazole nucleus, a nitrooxazole nucleus, a nitronaphthooxazole nucleus, a nitroselenazole nucleus, a nitronaphthoselenazole nucleus, or a nitropyridine nucleus; $X_2$ represents an anion; and $m_5$ and n are each 1 or 2, provided, n is i when a compound produces an intramolecular salt.

Formula III-d

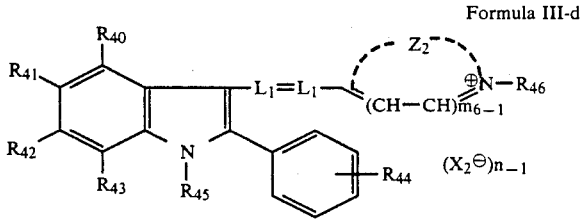

wherein $R_{40}$, $R_{41}$, $R_{42}$ and $R_{43}$ represent each a hydrogen atom, a halogen atom, an alkyl group. an alkoxy group, an aryloxy group, or a nitro group: $R_{44}$ represents a hydrogen atom, an alkyl group, or a nitro group: $Z_2$ represents the group of atoms necessary to complete a thiazole nucleus, a benzothiazole nucleus, a naphthothiazole nucleus, an oxazole nucleus, a benzooxazole nucleus, a naphthooxazole nucleus, a selenazole nucleus, a benzoselenazole nucleus, a naphthoselenazole nucleus, a thiazoline nucleus, a pyridine nucleus, a quinoline nucleus, an isoquinoline nucleus, a 3,3-dialkyl-3H-inzole nucleus, an imidazole nucleus, a benzoimidazole nucleus, or a naphthoimidazole nucleus, each of which is unsubstituted or substituted with a lower alkyl group, a phenyl group, a thienyl group, a halogen atom, an alkoxy group, a hydroxy group, a cyano group, an alkylsulfonyl group, an alkoxycarbonyl group. a phenylsulfonyl group, or a trifluoromethyl group; $L_1$ and $L_2$ represent each a methine chain which is unsubstituted or substituted with a lower alkyl group, or an aryl group: $R_{45}$ and $R_{46}$ represent each an alkyl group, an alkenyl group, an aryl group, a sulfoalkyl group, or an aralkyl group, each of which is unsubstituted or has a substituent; $X_2$ represents an anion; and $m_6$ and n are each 1 or 2, provided, n is 1 when a compound produces an intramolecular salt.

Formula III-e

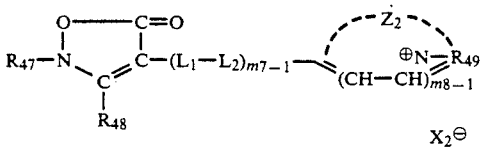

wherein $R_{47}$ and $R_{49}$ represent each an alkyl group; $R_{48}$ represents an aryl group; $L_1$ and $L_2$ represent each a methine chain unsubstituted or substituted with a lower alkyl group or an aryl group: $Z_3$ represents the group of atoms necessary to complete a thiazole nucleus, a benzothiazole nucleus. a naphthothiazole nucleus, an oxazole nucleus, a benzoxazole nucleus, a naphthooxazole nucleus, a selenazole nucleus, a benzoselenazole nucleus, a naphthoselenazole nucleus, a thiazoline nucleus, a pyridine nucleus, a quinoline nucleus, a 3.3-dialkylindolenine nucleus, an imidazole nucleus, or an imidazo[4/5-b]quinoxaline nucleus; $X_2$ represents an anion: $m_7$ is a positive integer of 1 to 3: and $m_8$ is 1 or 2.

Formula III-f

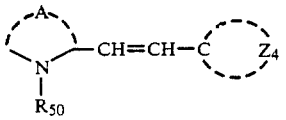

wherein $R_{50}$ represents an alkyl group, a hydroxyalkyl group, a cyanoalkyl group, or a sulfoalkyl group; $Z_4$ represents the group of atoms necessary to complete an oxazole ring, a thiazole ring, a benzoxazole ring, a benzothiazole ring, an imidazole ring, or a benzimidazole ring: and A represents the group of atoms necessary to complete a pyrrole ring, or a pyrrolidine ring.

Formula III-g

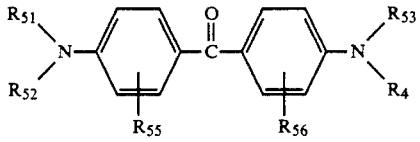

wherein $R_{51}$, $R_{52}$, $R_{53}$, and $R_{54}$ represent each an alkyl group, a hydroxyalkyl group, a cyano group, an alkylcyano group, an alkoxy group, or a sulfoalkyl group; and $R_{55}$ and $R_{56}$ represent each a sulfonic acid group, or an alkylsulfonic acid group.

Next the typical compounds of the desensitizing dyes and UV absorbents each preferably applicable to the invention will be exemplified below. It is, however, to be understood that the dyes and absorbents applicable to the invention shall not be limited thereto. Among the exemplified compounds of the following III-1 through III-36, some of them do not have the above-given formulas, and pts represents a paratoluenesulfonic acid group.

(III-1)

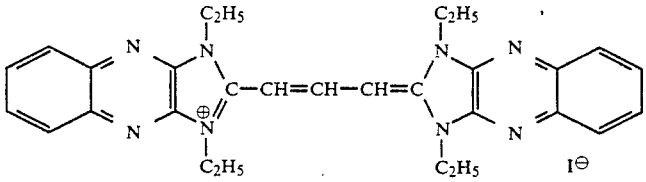

(III-2)

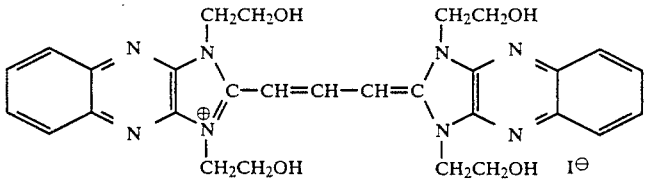

(III-3)

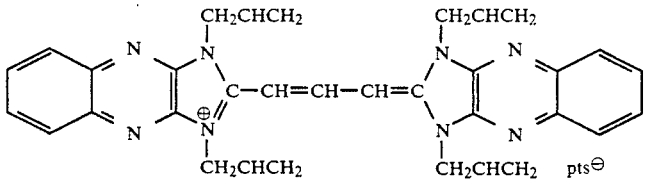

(III-4)

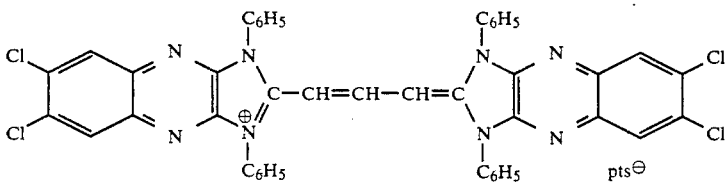

(III-5)

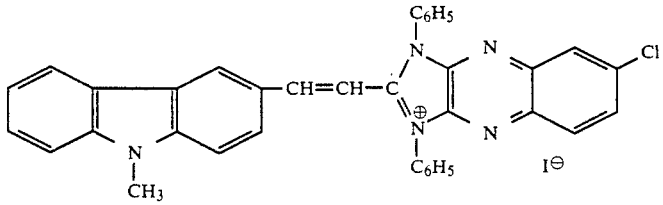

-continued
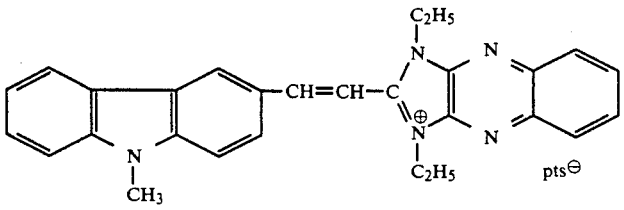
(III-6)
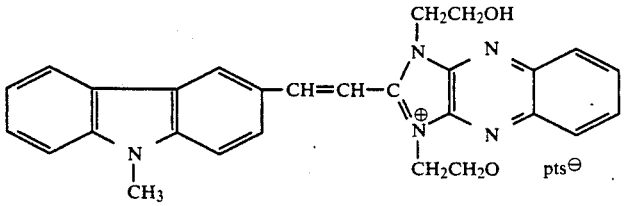
(III-7)
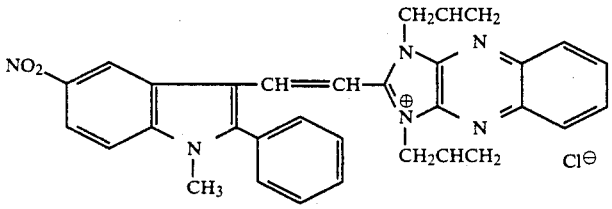
(III-8)
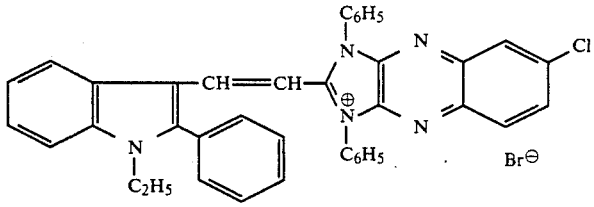
(III-9)
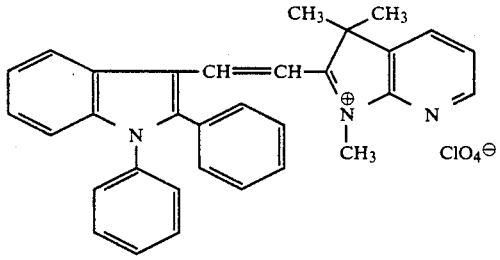
(III-10)
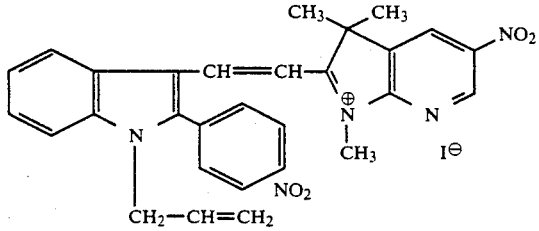
(III-11)
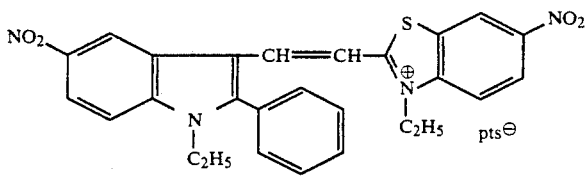
(III-12)

-continued
(III-13)
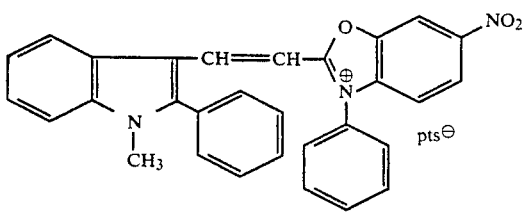
(III-14)
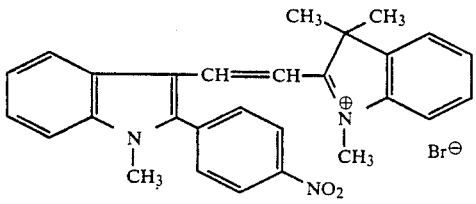
(III-15)
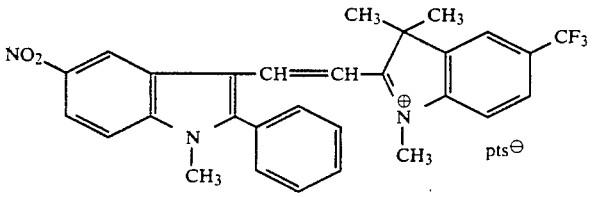
(III-16)
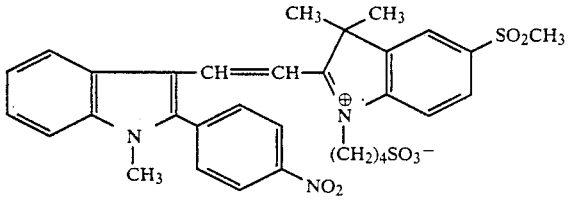
(III-17)
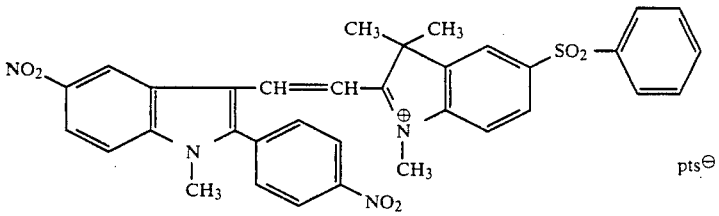
(III-18)
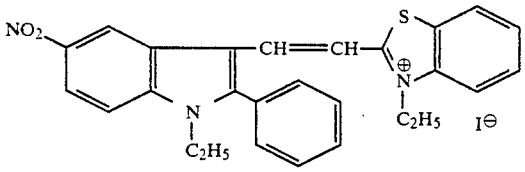
(III-19)
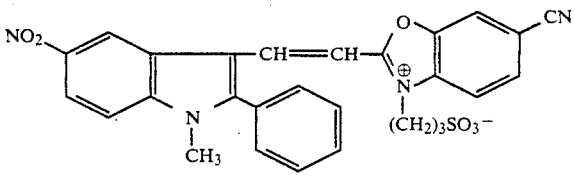
(III-20)
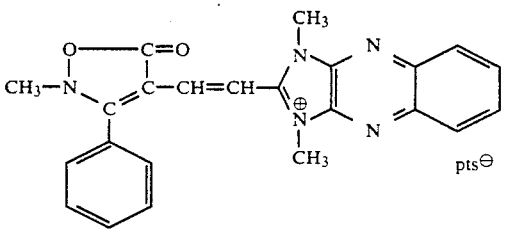

-continued
(III-21)
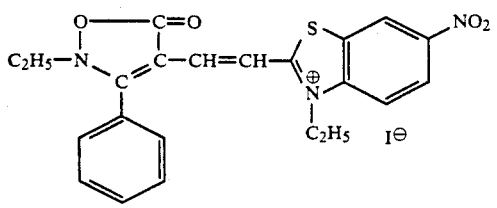
(III-22)
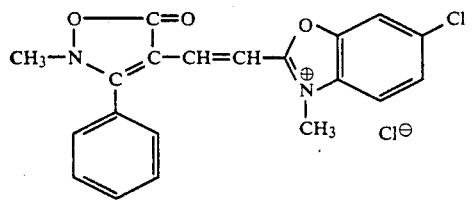
(III-23)
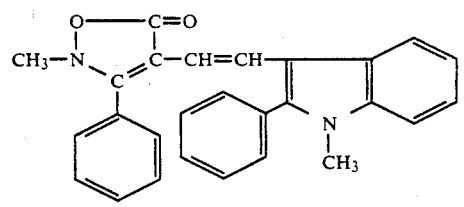
(III-24)
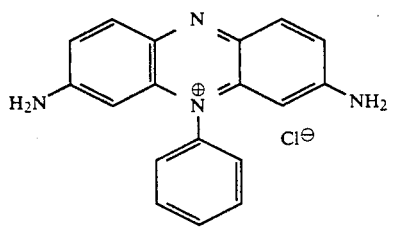
(III-25)
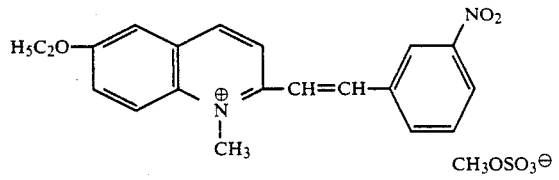
(III-26)
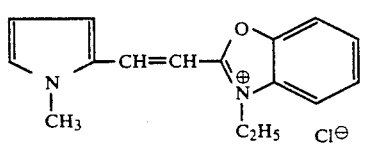
(III-27)
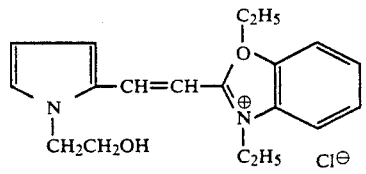
(III-28)
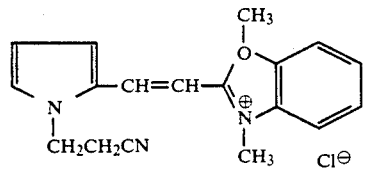

-continued
(III-29)
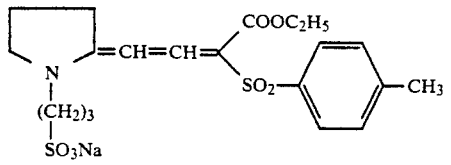
(III-30)
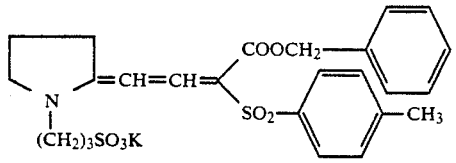
(III-31)
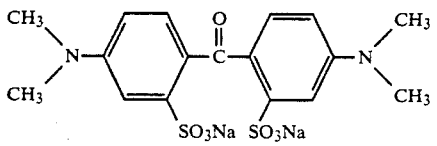
(III-32)
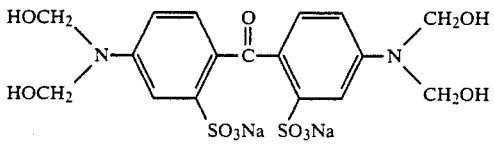
(III-33)
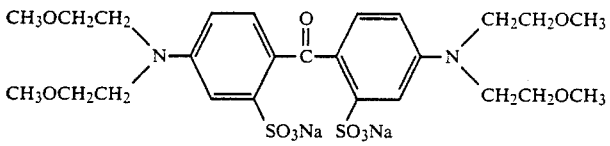
(III-34)
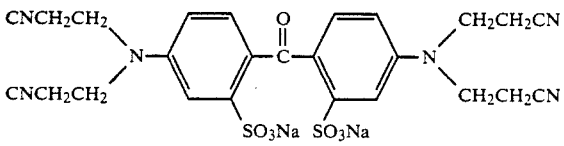
(III-35)
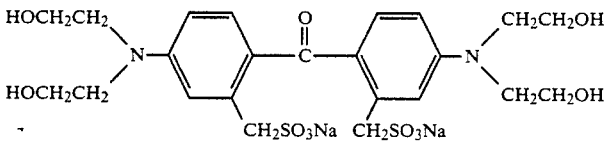
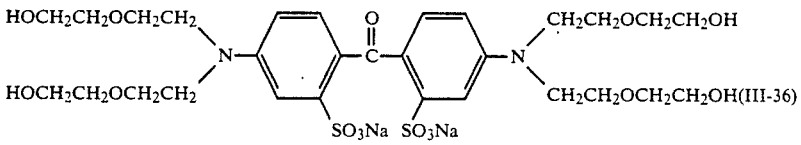
(III-36)
(III-37)
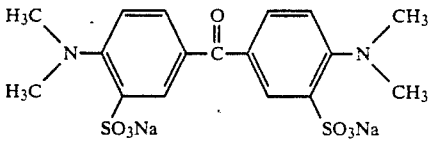
(III-38)
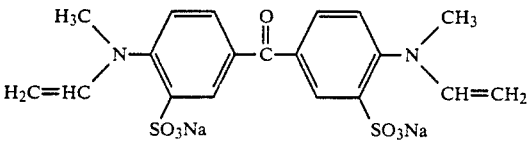

-continued

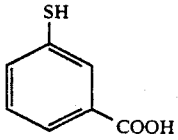

(III-39)

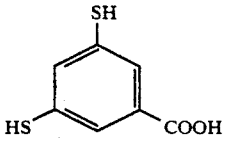

(III-40)

The silver halide emulsions applicable to the invention may be stabilized with the use of the compounds described in, for example, U.S. Pat. Nos 2,444,607, 2,716,062, and 3,512,982; West German DAS Patent Nos. 1,189,380, 2,058,626, and 2,118,411; Japanese Patent Examined Publication No. 43-4133(1968); U.S. Pat. No. 3,342,596; Japanese Patent Examined Publication No. 47-4417(1972); West German DAS Patent No. 2,149,789; Japanese Patent Examined Publication Nos. 39-2825(1964) and 49-13566(1974) and, preferably, for example, 5,6-trimethylene-7-hydroxy-S-triazolo(1,5-a)pyrimidine, 5,6-tetramethylene-7-hydroxy-S-triazolo(1,5-a)pyrimidine, 5-methyl-7-hydroxy-S-triazolo(1,5-a)pyrimidine, 5-methyl-7-hydroxy-S-triazolo(1,5-a)pyrimidine, 7-hydroxy-S-triazolo(1,5-a)pyrimidine, 5-methyl-6-bromo-7-hydroxy-S-triazolo(1,5-a)pyrimidine, gallic acid esters such as isoamyl gallate, dodecyl gallate, propyl gallate, and sodium gallate, mercaptanes such as 1-phenyl-5-mercaptotetrazole, and 2-mercaptobenzthiazole, benzotriazoles such as 5-bromobenztriazole, and 5-methylbenztriazole, or benzimidazoles such as 6-nitrobenzimidazole.

It is preferable that the silver halide photographic light-sensitive materials and/or the developers, each relating to the invention, contain an amino compound.

The amino compounds preferably applicable to the invention include all of the primary through quaternary amines.

The examples of the preferable amino compounds include an alkanolamines. Now, the preferable examples thereof will be given below. It is however to be understood that the invention shall not be limited thereto.

Diethylaminoethanol,
Diethylaminobutanol,
Diethylaminopropane-1,2-diol,
Dimethylaminopropane-1,2-diol,
Diethanolamine,
Diethylamino-1-propanol,
Triethanolamine,
Dipropylaminopropane-1,2-diol,
Dioctylamino-1-ethanol,
Dioctylaminopropane-1,2-diol,
Dodecylaminopropane-1,2-diol,
Dodecylamino-1-propanol,
Dodecylamino-1-ethanol,
Aminopropane-1,2-diol,
Diethylamino-2-propanol,
Dipropanolamine,
Glycine,
Triethylamine, and
Triethylenediamine The amino compounds may be contained in at least one of the coated layers, i.e., hydrophilic layers such as silver halide emulsion layers, a protective layer, and a subbing layer, each arranged on the side of the light-sensitive layers of a silver halide photographic light-sensitive material, and/or in a developer. The preferable embodiment is to contain the amino compound in a developer. Content of the amino compound depends on the subjects to be contained and the kinds of amino compounds. However, the contents of the amino compounds should be in an amount as much as an image contrast may be increased.

For improving the developability, a developing agent such as phenidone or hydroquinone, and/or an inhibitor such as benzotriazole may be added into an emulsion-side; or for improving the processability of a processing solution, the developing agent and/or inhibitor may be added into a backing layer.

A hydrophilic colloid which is particularly advantageous to the invention is gelatin. Besides the gelatin, the other hydrophilic colloids may be used, which include, for example, colloidal albumin, agar-agar, gum arabic, alginic acid, hydrolyzed cellulose acetate, acrylamide, imide-modified polyamide, polyvinyl alcohol, hydrolyzed polyvinyl acetate, and gelatin derivatives including, phenylcarbamyl gelatin, acylated gelatin, and phthalated gelatin described in, for example, U.S. Pat. Nos. 2,614,928 and 2,525,753, and gelatin which is graft-polymerized with a polymerizable monomer having an ethylene group, such as styrene acrylate, acrylates methacrylic acid, and methacrylates, each described in, for example, U.S. Pat. Nos. 2,548,520 and 2,831,767. Those hydrophilic colloids may also be applied to any layers not containing silver halide, such as an antihalation layer, a protective layer, and an interlayer.

The supports applicable to the invention typically include, for example, polyethylene laminated paper, polypropylene synthetic paper, cellulose acetate film, cellulose nitrate film, polyester film such as polyethyleneterephthalate film, polyamide film, polypropylene film, polycarbonate film, and polystyrene film. The supports may suitably be selected so as to satisfy the purposes of using silver halide photographic light-sensitive materials.

The developing agents applicable to the developments of the silver halide photographic light-sensitive materials relating to the invention include the following. The typical examples of the HO—(CH=CH-)n—OH type developing agents include hydroquinone and, besides, catechol, pyrogallol and the derivatives thereof, ascorbic acid, chlorohydroquinone, bromohydroquinone, methylhydroquinone, 2,3-dibromohydroquinone, 2,5-diethylhydroquinone, 4-chlorocatechol, 4-phenyl-catechol, 3-methoxy-catechol, 4-acetylpyrogallol, and sodium ascorbate.

The HO—(CH=CH)n—$NH_2$ type developing agents typically include ortho- or para-aminophenol and, besides, 4-aminophenol, 2-amino-6-phenylphenol, 2-amino-4-chloro-6-phenylphenol, and N-methyl-p-aminophenyl.

Further, the $H_2N—(CH=CH)n—NH_2$ type developing agents include, for example, 4-amino-2-methyl-N,N-diethylaniline, 2,4-diamino-N,N-diethylaniline, N-(4-amino-3-methylphenyl)-morpholine, and p-phenylenediamine.

The heterocyclic type developing agents include, for example, 3-pyrazolidones such as 1-phenyl-3-pyrazolidone, 1-phenyl-4,4-dimethyl-3-pyrazolidone, and 1-phenyl-4-methyl-4-hydroxymethyl-3-pyrazolidone, 1-phenyl-4-amino-5-pyrazolone, and 5-aminolaucyl.

Besides the above, those described in, for example, T.H. James, The Theory of Photographic Process, 4th Ed., pp. 291–334, and Journal of the American Chemical Society, Vol. 73, p. 3,100, 1951, are also effectively applicable to the invention. The above-given developing agents may be used independently or in combination and the combination use is more preferable. Even if a sulfite such as sodium sulfite or potassium sulfite should be added as a preservative into a developer to be used for developing a light-sensitive material relating to the invention, the addition thereof will detract little from the effects of the invention. A hydroxylamine or hydrozide compound may be used as such a preservative as mentioned above. In this case, it is to be used in an amount within the range of, preferably, 5 to 500 g per liter of a developer used and, more preferably, 20 to 200 g.

Such a developer may contain a glycol to serve as an organic solvent. Such glycols include, for example, ethylene glycol, diethylene glycol, propylene glycol, triethylene glycol, 1,4-butanediol, and 1,5-pentanediol. Among them, diethylene glycol is preferably used. Such glycol may be preferably used in an amount within the range of, preferably, 5 to 500 g per liter of a developer used and, more preferably, 20 to 200 g. These organic solvents may be used independently or in combination.

The developers having the above-mentioned composition should have a pH within the range of, preferably, 9 to 13 and, more preferably, 10 to 12 from the viewpoints of preservability and photographic characteristics. About the cations contained in a developer, potassium ions are more preferable than sodium ions, because the more a potassium ion content is higher than a sodium ion content, the more a developer activity can be made higher.

The silver halide photographic light-sensitive materials relating to the invention may be processed in various conditions. For example, a developing temperature should preferably be at a temperature of not higher than 50° C. and, more preferably, be at a temperature approximately within the range of 25° to 40° C. It is general to complete a development within 2 minutes and, in particular, it may often produce good results when a development is completed within the range of 10 to 50 seconds. It is also arbitrary to take other processing steps than the developing step, such as the steps of washing, stopping, stabilizing, fixing, and, if required, prehardening and neutralizing, or to appropriately omit such processing steps. Further, such processing steps may be carried out in any processing manners including, for example, the so-called hand processing such as a tray processing and a frame processing, and the mechanical processing such as a roller processing and a hanger processing.

EXAMPLES

Now, the invention will be detailed with reference to the following examples. It is the matter of course that the invention shall not be limited to the following examples.

EXAMPLE -1

The silver halide emulsion were prepared, under the acidic atmospheric conditions at a pH of 3.0 in a controlled double-jet process, so as to contain rhodium in an amount of $10^{-5}$ mol per mol of silver and to have the average grain-sizes and the monodispersion degrees each shown in Table-1. The grains were formed in a system containing benzyl adenine in an amount of 30 mg per liter of an aqueous 1% gelatin solution. After mixing a soluble silver and soluble halide for forming the emulsion. 6-methyl-4-hydroxy-1,3,3a,7-tetraazaindene was added in an amount of 600 mg per mol of silver halide. Then the emulsion was washed for desalting.

The emulsion is sulfur-sensitized after addition of 6-methyl-4-hydroxy-1,3,3a,7-tetraazaindene in an amount of 60 mg per mol of silver halide. After the sulfur-sensitization, 6-methyl-4-hydroxy-1,3,3a,7-tetraazaindene was so added to the emulsion as to serve as a stabilizer.

Silver halide emulsion layer

The following additives were so prepared to be in the amounts listed below and were then added to the emulsions. The resulting emulsions were coated on a 100 μm-thick polyethyleneterephthalate support latex-sublayered in the manner as in Example-1 of Japanese Patent O.P.I. Publication No. 59-19941(1984). (The support was previously subjected to 30 wat/$m^2$·$min^{-1}$ of colona discharge on the surfaces thereof and subbed with a solution containing a copolymer styrene-butyl acrylate-glycidyl methacrylate.)

| | |
|---|---|
| Polymer Latex: Styrene-butyl acrylate-acrylic acid ternary copolymer | 1.0 g/$m^2$ |
| Tetraphenyl phosphonium chloride | 30 mg/$m^2$ |
| Saponin | 200 mg/$m^2$ |
| Polyethylene glycol | 100 mg/$m^2$ |
| Sodium dodecylbenzenesulfonate | 100 mg/$m^2$ |
| Hydroquinone | 200 mg/$m^2$ |
| Phenidone | 100 mg/$m^2$ |
| Styrene-maleic acid polymer | 200 mg/$m^2$ |
| Butyl gallate | 500 mg/$m^2$ |
| Hydrazine compound having Formula I | See Table-1 |
| 5-methylbenzotriazole | 30 mg/$m^2$ |
| Desensitizer having Formula III | See Table-1 |
| 2-mercaptobenzimidazole-5-sulfonic acid | 30 mg/$m^2$ |
| Inert ossein gelatin having an isoelectric point of 4.9 | 1.5 g/$m^2$ |
| 1-(p-acetylamidophenyl)-5-mercaptotetrazole | 30 mg/$m^2$ |
| Coating weight of Silver | 2.8 g/$m^2$ |

Protective layer for Emulsion layer

A protection layer having the following composition was coated over the emulsion layer.

| | |
|---|---|
| Fluorinated dioctylsulfosuccinate | 300 mg/$m^2$ |
| Matting agent: Methyl polymethacrylate, having an average particle-size of 3.5 μm | 100 mg/$m^2$ |
| Lithium nitrate | 30 mg/$m^2$ |
| Acid-treated gelatin, having an isoelectric point of 7.0 | 1.2 g/$m^2$ |
| Colloidal silica | 50 mg/$m^2$ |
| Styrene-maleic acid copolymer | 100 mg/$m^2$ |

-continued

Mordant having the following structure 0.5 g/m²

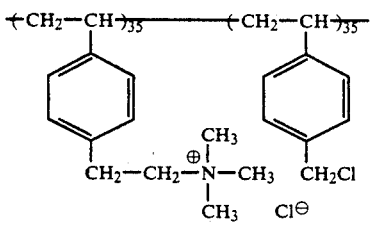

Dye 0.2 g/m²

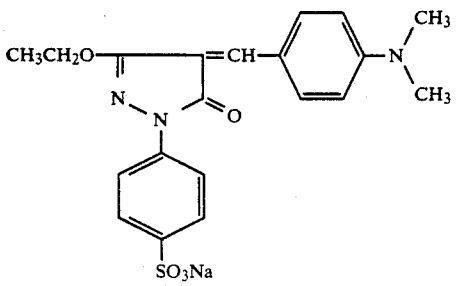

Metal oxide containing layer

A metal oxide containing layer having the following composition was coated over the side of the support opposite to the emulsion layer coated

| | |
|---|---|
| Metal oxide | See Table-1 |
| Alkali treated gelatin | 0.5 g/m² |

An appropriate amount of sodium salt of 2,4-dichloro-6-hydoxy-s-triazine was contained as a hardner.

Backing layer

A backing layer having the following composition was coated over the metal oxide-containing layer.

| | |
|---|---|
| Hydroquinone | 100 mg/m² |
| Phenidone | 30 mg/m² |
| Latex polymer: | 0.5 mg/m² |
| Butyl acrylate-styrene copolymer | |
| Copolymer of the invention | See Table 1 |
| Ctric acid | 40 mg/m² |
| Saponin | 200 mg/m² |
| Benzotriazole | 100 mg/m² |
| Lithium nitrate | 30 mg/m² |
| Backing dyes | |

(a) 40 mg/m²

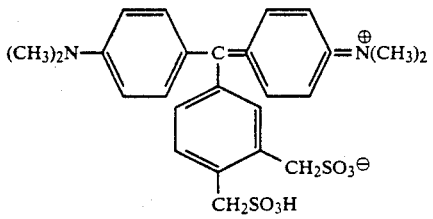

-continued (b) 30 mg/m²

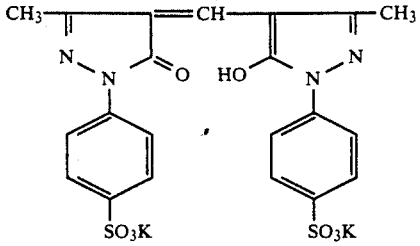

(c) 30 mg/m²

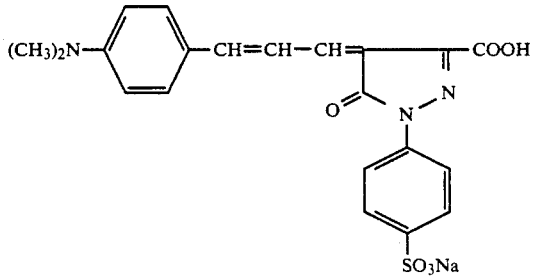

Ossein gelatin 2.0 g/m²

Protective layer for backing layer

Further, a protective layer having the following composition was coated over the backing layer.

| | |
|---|---|
| Dioctyl sulfosuccinate | 300 mg/m² |
| Matting agent: Methyl polymethacrylate, having an average particle-size of 4.0 μm | 100 mg/m² |
| Colloidal silica | 30 mg/m² |
| Ossein gelatin having an isoelectric point of 4.9 | 1.1 g/m² |
| Fluorinated sodium dodecylbenzenesulfonate | 50 mg/m² |

The samples thus prepared were exposed to light emitted from the light-sources shown in Table-1, and were then treated with the following developer and fixer, respectively.

Method of exposure

Beneath a glass plate, a non-electrode discharging light-source called V-bulb having a maximum specific-energy within the range of 400 to 420 nm, manufactured by Fusion Co., U.S.A., or a conventional type light-source called D-bulb having a maximum specific-energy within the range of 350 to 380 nm was attached. An original document and a light-sensitive material were placed on the glass plate and were then exposed to light so that the quality of a reverse-text could be evaluated.

Composition of developer

| | |
|---|---|
| Hydroquinone | 25 g |
| 1-phenyl-4,4-dimethyl-3-pyrazolidone | 0.4 g |
| Sodium bromide | 3 g |
| 5-methylbenzotriazole | 0.3 g |
| 5-nitroindazole | 0.05 g |
| Diethylaminopropane-1,2-diol | 10 g |
| Potassium sulfite | 90 g |
| Sodium 5-sulfosalicylate | 75 g |
| Sodium ethylenediaminetetraacetate | 2 g |

-continued

| | |
|---|---|
| Add water to make | 1 liter |
| Adjust pH with caustic soda to | pH = 11.5 |

Composition of fixer

| | |
|---|---|
| Composition A | |
| Ammonium thiosulfate in an aqueous 72.5 w % solution | 240 ml |
| Sodium sulfite | 17 g |
| Sodium acetate, trihydrate | 6.5 g |
| Boric acid | 6 g |
| Sodium citrate, dihydrate | 2 g |
| Acetic acid in an aqueous 90 w % solution | 13.6 ml |
| Composition B | |
| Pure water, i.e., ion-exchanged water | 17 ml |
| Aluminum sulfate in an aqueous 8.1 w % solution in terms of an $Al_2O_3$ content | 20 g |

The above-given compositions A and B were dissolved in order in 500 ml of water to make 1 liter when the resulting solution was used as the fixer. The pH value of the fixer was adjusted to be pH=6.0.

Processing conditions

| Processing step | Temperature | Time |
|---|---|---|
| Developing | 50° C. | 6 sec. |
| Fixing | 35° C. | 10 sec. |

-continued

| Processing step | Temperature | Time |
|---|---|---|
| Washing | At ordinary temperature | 10 sec. |

The evaluations were made as described below and the results thereof are shown in Table-1.

Method of evaluating photographic characteristics

<1> Characteristics improved on pin-holes

A sample of light-sensitive material to be tested was contact to a film having an uniform 50% halftone dot image, and exposed to light and processed. After it, Pin-hole produced in the printed halftone image were evaluated by five grades. In the 5-grade evaluation, it was evaluated as Grade 5 when no pin-hole was found, and Grade 1 when the most numerous pin-holes were found; and so forth, respectively.

<2> Reverse-text quality

A reverse-text quality means a quality of reversed image of a 50 μm-width line contact printed on a sample to be tested from a line image chart superposed on a halftone image when the exposure is given so as a 50% halftone dot area of an original image to be reproduced as a 50% halftone dot area on the printed film. Each of the reverse-text quality was evaluated by 5 grades. It was correlatively evaluated as Grade 5 when the lines of a reverse-text could sharply be reproduced: Grade 1 when the lines could scarcely be identified; and so forth, respectively.

The results of the evaluations are shown in Table-1.

TABLE 1

| | | Emulsion Layer | | | | | | | | |
|---|---|---|---|---|---|---|---|---|---|---|
| | | Silver halide grain | | | | | Compound of Formula Ia | | Compound of Formula III | |
| | | Average grain size | Mono dispersion | AgX composition (mol %) | | | | | | |
| Sample | Sample No. | (um) | degree | Cl/ | Br/ | I | No. | Amt. added mg/m² | No. | Amt. added mg/m² |
| Comp. | 1 | 0.10 | 15 | 90 | 10 | 0 | — | — | — | — |
| Comp. | 2 | 0.10 | 15 | 90 | 10 | 0 | — | — | — | — |
| Comp. | 3 | 0.10 | 15 | 90 | 10 | 0 | — | — | — | — |
| Comp. | 4 | 0.10 | 15 | 90 | 10 | 0 | I-1 | 31 | — | — |
| Comp. | 5 | 0.10 | 15 | 90 | 10 | 0 | I-1 | 31 | — | — |
| Inv. | 6 | 0.10 | 15 | 90 | 10 | 0 | I-1 | 31 | — | — |
| Inv. | 7 | 0.10 | 15 | 90 | 10 | 0 | I-1 | 31 | — | — |
| Inv. | 8 | 0.10 | 15 | 90 | 10 | 0 | I-3 | 31 | — | — |
| Inv. | 9 | 0.10 | 15 | 90 | 10 | 0 | I-3 | 31 | — | — |
| Inv. | 10 | 0.12 | 18 | 100 | 0 | 0 | I-3 | 31 | — | — |
| Inv. | 11 | 0.12 | 18 | 100 | 0 | 0 | I-3 | 31 | — | — |
| Inv. | 12 | 0.11 | 16 | 95 | 5 | 0 | I-47 | 40 | — | — |
| Inv. | 13 | 0.11 | 16 | 95 | 5 | 0 | I-47 | 40 | — | — |
| Inv. | 14 | 0.15 | 15 | 90 | 9 | 1 | I-47 | 40 | — | — |
| Inv. | 15 | 0.15 | 15 | 90 | 9 | 1 | I-47 | 40 | III-4 | 20 |
| Inv. | 16 | 0.15 | 15 | 90 | 9 | 1 | I-48 | 40 | III-18 | 26 |
| Inv. | 17 | 0.20 | 15 | 100 | 0 | 0 | I-49 | 40 | III-18 | 26 |
| Inv. | 18 | 0.20 | 15 | 100 | 0 | 0 | I-50 | 40 | III-18 | 26 |
| Inv. | 19 | 0.20 | 15 | 100 | 0 | 0 | I-51 | 40 | III-18 | 26 |
| Inv. | 20 | 0.20 | 15 | 100 | 0 | 0 | I-53 | 40 | III-10 | 26 |
| Inv. | 21 | 0.20 | 15 | 100 | 0 | 0 | I-53 | 40 | III-18 | 26 |
| Inv. | 22 | 0.20 | 15 | 100 | 0 | 0 | I-53 | 40 | III-18 | 26 |

| | | Metal-oxide containing layer | | Backing layer | | | Photographic Characteristics | |
|---|---|---|---|---|---|---|---|---|
| | | Metal Oxide | | Polymer II | | Light | Pin-hole | reverse- |
| Sample | Sample No. | Kinds | Amt. added, g/m² | No. | Amt. added, g/m² | Source for Exposure | improved character-istics | text character-istics |
| Comp. | 1 | — | — | — | 1.0 | D-bulb | 1 | 1 |
| Comp. | 2 | Stannic oxide | 0.1 | — | 1.0 | " | 2 | 1 |
| Comp. | 3 | Indic oxide | 0.1 | — | 1.0 | " | 2 | 1 |
| Comp. | 4 | — | — | II-1 | 1.0 | " | 2 | 3 |
| Comp. | 5 | — | — | II-1 | 1.0 | " | 2 | 3 |
| Inv. | 6 | Stannic oxide | 0.1 | II-1 | 1.0 | " | 4 | 4 |

TABLE 1-continued

| | | | | | | | | |
|---|---|---|---|---|---|---|---|---|
| Inv. | 7 | Indic oxide | 0.1 | II-1 | 1.0 | " | 4 | 4 |
| Inv. | 8 | Stannic oxide | 0.1 | II-2 | 1.0 | " | 4 | 4 |
| Inv. | 9 | Indic oxide | 0.1 | II-3 | 1.0 | " | 4 | 4 |
| Inv. | 10 | Stannic oxide | 0.1 | II-3 | 1.0 | " | 4 | 4 |
| Inv. | 11 | Indic oxide | 0.1 | II-4 | 1.0 | " | 4 | 4 |
| Inv. | 12 | Stannic oxide doped w/1% antimony | 0.1 | II-4 | 1.0 | " | 4 | 5 |
| Inv. | 13 | Stannic oxide doped w/1% indic | 0.1 | II-6 | 1.0 | " | 4 | 4 |
| Inv. | 14 | Stannic oxide doped w/1% antimony | 0.2 | II-8 | 1.0 | " | 4 | 5 |
| Inv. | 15 | Stannic oxide doped w/1% antimony | 0.3 | II-2 | 1.0 | " | 4.5 | 5 |
| Inv. | 16 | Stannic oxide doped w/1% antimony | 0.5 | II-2 | 1.0 | " | 4.5 | 5 |
| Inv. | 17 | Stannic oxide doped w/1% antimony | 0.5 | II-2 | 1.0 | " | 4.5 | 5 |
| Inv. | 18 | Stannic oxide doped w/1% antimony | 0.5 | II-2 | 1.0 | " | 4.5 | 5 |
| Inv. | 19 | Stannic oxide doped w/1% antimony | 0.5 | II-3 | 1.0 | " | 4.5 | 5 |
| Inv. | 20 | Stannic oxide doped w/1% antimony | 0.5 | II-4 | 1.0 | " | 4.5 | 5 |
| Inv. | 21 | Stannic oxide doped w/1% antimony | 0.5 | II-4 | 1.0 | " | 5 | 5 |
| Inv. | 22 | Stannic oxide doped w/1% antimony | 0.5 | II-4 | 1.0 | V-bulb | 5 | 5 |

*Energy maximum (nm)
Exposure light-sources:
D-bulb: 350 to 380 nm
V-bulb: 400 to 420 nm.

From Table-1, it is understood that pin-hole productions can be inhibited and, at the same time, the characteristics of reverse-texts can also be improved, in the samples of the present invention having layers containing a metal oxide and polymer of the invention, respectively.

EXAMPLE-2

In this example, the samples were prepared in the same manner as in Example-1, except that the mixture of two kinds of silver halide grains, namely, one for the main and the other for the secondry silver halide grains, was used. The main silver halide grains were 2 mol % iodide-containing cubic silver iodobromide grains having an average grain-size of 0.12 μm and a monodispersion degree of 15 and further containing rhodium in an amount of $10^{-5}$ mols thereinside. The secondry silver halide grains were 2 mol % silver bromide-containing cubic silver chlorobromide grains having an average grain-size of 0.08 μm and a monodispersion degree of 15 and further containing rhodium thereinside in an amount of $2\times10^{-5}$ mols and, those were lower in sensitivity than the main grains The above-mentioned two kinds of grains were mixed up in a proportion of 1 part of the main grains to 10 parts of the secondry grains and the same additives as in Example-1 were added, so that the samples of this example were prepared.

TABLE 2

| | | Emulsion Layer | | | | | | | | | Photographic Characteristic | |
|---|---|---|---|---|---|---|---|---|---|---|---|---|
| | | Tetrazolium Compounds of the Invention | | Compound of Formula III | | Metal Oxide Containing Layer Metal Oxide | | Backing Layer Polymer | | | | |
| Sample | Sample No. | No. | Amt. added mg/m² | No. | Amt. added mg/m² | Kinds | Amt. added g/m₂ | Kinds | Amt. added g/m₂ | Light Source for Exposure | Pin-hole improved Characteristics | Reverse-text Characteristics |
| Comp. | 23 | 2 | 20 | III-3 | 10 | — | — | II-1 | 1.0 | V-bulb | 2 | 4 |
| Inv. | 24 | 3 | 30 | III-5 | 30 | Stannic oxide doped w/ 1% P | 1 | II-1 | 1.0 | V-bulb | 5 | 5 |
| Inv. | 25 | 6 | 30 | III-8 | 20 | Stannic oxide doped w/ 1% P | 1 | II-1 | 1.0 | V-bulb | 5 | 5 |
| Inv. | 26 | 8 | 30 | III-10 | 30 | Stannic oxide doped w/ 1% P | 1 | II-1 | 1.0 | V-bulb | 5 | 5 |
| Inv. | 27 | 10 | 30 | III-12 | 30 | Stannic oxide doped w/ 1% P | 1 | II-1 | 1.0 | V-bulb | 5 | 5 |
| Inv. | 28 | 11 | 30 | III-14 | 30 | Stannic oxide doped w/ 5% P | 1 | II-3 | 1.0 | V-bulb | 5 | 5 |
| Inv. | 29 | 12 | 30 | III-16 | 30 | Stannic oxide | 0.5 | II-3 | 1.0 | V-bulb | 5 | 5 |

TABLE 2-continued

| Sample | Sample No. | Emulsion Layer: Tetrazolium Compounds of the Invention No. | Amt. added mg/m² | Compound of Formula III No. | Amt. added mg/m² | Metal Oxide Containing Layer: Metal Oxide Kinds | Amt. added g/m2 | Backing Layer: Polymer Kinds | Amt. added g/m2 | Light Source for Exposure | Photographic Characteristic: Pin-hole improved Characteristics | Reverse-text Characteristics |
|---|---|---|---|---|---|---|---|---|---|---|---|---|
| | | | | | | doped w/ 5% P | | | | | | |
| Inv. | 30 | 13 | 30 | III-18 | 45 | Stannic oxide doped w/ 5% P | 0.5 | II-3 | 1.0 | V-bulb | 5 | 5 |
| Inv. | 31 | 3 | 20 | III-20 | 60 | Stannic oxide doped w/ 5% P | 0.5 | II-3 | 1.0 | V-bulb | 5 | 5 |
| Inv. | 32 | 3 | 20 | III-20 | 30 | Stannic oxide doped w/ 5% P | 0.5 | II-3 | 1.0 | V-bulb | 5 | 5 |
| Inv. | 33 | 3 | 20 | III-24 | 20 | Stannic oxide doped w/ 8% P | 0.8 | II-4 | 1.0 | V-bulb | 5 | 5 |
| Inv. | 34 | 15 | 30 | III-26 | 20 | Stannic oxide doped w/ 8% P | 0.8 | II-4 | 1.0 | V-bulb | 5 | 5 |
| Inv. | 35 | 16 | 30 | III-28 | 50 | Stannic oxide doped w/ 8% P | 0.8 | II-4 | 1.0 | V-bulb | 5 | 5 |
| Inv. | 36 | 18 | 30 | III-29 | 50 | Stannic oxide doped w/ 8% P | 0.8 | II-4 | 1.0 | V-bulb | 5 | 5 |

As is obvious from the results shown in Table-2, it can be understood that, in the combination relating to the invention, pin-hole productions can be inhibited and reverse-text characteristics can also be improved by providing a layer containing a metal oxide of the invention, even when applying a tetrazolium compound into a silver halide emulsion.

What is claimed is:

1. A silver halide photographic light-sensitive material comprising a support, a silver halide emulsion layer being provided on a surface of said support and containing a tetrazolium compound or a hydrazine compound, a metal oxide-containing layer containing a tin oxide or an indium oxide and being provided on the surface of said support opposite to said surface, on which said emulsion layer is provided, and a polymer-containing layer containing a homopolymer or a copolymer comprising sodium styrenesulfonate, and being provided directly or through an intermediate layer on the surface of said metal oxide containing layer further to said support.

2. The material of claim 1, wherein said indium oxide and said tin oxide are stannic oxide and indic oxide, respectively.

3. The material of claim 1, wherein said tin oxide and said indium oxide are each doped with an antimony atom or a phosphorus atom.

4. The material of claim 1, wherein said metal oxide-containing layer contains said tin oxide or said indium oxide in an amount of from 0.01 g/m² to 10 g/m².

5. The material of claim 4, wherein said metal oxide-containing layer contains said tin oxide or said indium oxide in an amount of from 0.1 g/m² to 1 g/m².

6. The material of claim 1, wherein said homopolymer and copolymer each comprising sodium styrenesulfonate each has each a molecular weight of from 1,000 to 1,000,000.

7. The material of claim 6, wherein said homopolymer and copolymer each comprising sodium styrenesulfonate each has a molecular weight of from 5,000 to 1,000,000.

8. The material of claim 1, wherein said polymer-containing layer contains said homopolymer or copolymer in an amount of from 0.1 g/m² to 10 g/m².

9. The material of claim 1, wherein said polymer-containing layer contains said homopolymer or copolymer in an amount of from 0.2 g/m² to 5 g/m².

10. The material of claim 1, wherein said hydrazine compound is a compound represented by the following Formula Ia:

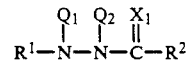

Ia wherein $R^1$ is a monovalent organic group; $R^2$ is a hydrogen atom or a monovalent organic group; $Q_1$ and $Q_2$ are each a hydrogen atom, a substituted or unsubstituted alkylsulfonyl group or a substituted or unsubstituted arylsulfonyl group; and $X_1$ is an oxygen atom or a sulfur atom.

11. The material of claim 1, wherein said hydrazine compound is contained said silver halide emulsion layer in an amount of $10^{-5}$ mol to $10^{-1}$ mol per mol of silver halide contained in said emulsion layer.

12. The material of claim 11, wherein said hydrazine compound is contained said silver halide emulsion layer in an amount of $10^{-4}$ mol to $10^{-2}$ mol per mol of silver halide contained in said emulsion layer.

13. The material of claim 1, wherein said tetrazolium compound is a compound represented by the following Formula Ib, Ic or Id:

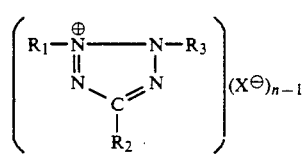

(Ib)

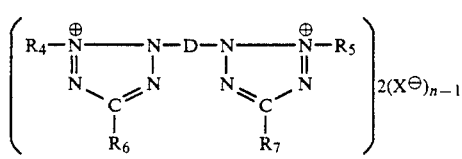

(Ic)

-continued (Id)

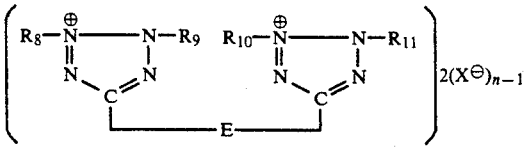

wherein $R_1$, $R_3$, $R_4$, $R_5$, $R_8$, $R_9$, $R_{10}$ and $R_{11}$ are each an alkyl group, an alkenyl group, an aryl group or a heterocyclic group, provided that these groups are allowed to have a substituent; $R_2$, $R_6$ and $R_7$ are each an allyl group, a phenyl group, a naphthyl group, a heterocyclic group, an alkyl group, a hydroxyl group, a carboxyl group, an alkoxycarbonyl group, an amino group, a mercapto group, a nitro group or a hydrogen atom, provided that these groups are allowed to have a substituent; D is an aromatic group; E is an alkylene group, an arylene group or a aralkylene group; $X^{\ominus}$ is an anion and n is an integer of 1 or 2, provided that n is 1 when an intramolecular salt is formed.

14. The material of claim 1, wherein said tetrazolium compound is contained in said silver halide emulsion layer in an amount of from $10^{-6}$ mol to 10 mol per mol of silver halide contained said emulsion layer.

15. The material of claim 14, wherein said tetrazolium compound is contained in said silver halide emulsion layer in an amount of from $2\times10^{-4}$ mol to $2\times10^{-1}$ mol per mol of silver halide contained said emulsion layer.

16. The material of claim 1, wherein said silver halide photographic material contains a desensitizer and/or a UV absorber.

* * * * *

UNITED STATES PATENT AND TRADEMARK OFFICE

CERTIFICATE OF CORRECTION

PATENT NO. : 5,026,622

DATED : June 25, 1991

INVENTOR(S) : Taketoshi Yamada et al.

It is certified that error appears in the above-identified patent and that said Letters Patent is hereby corrected as shown below:

Claim 1, column 39, line 47, change "oxide containing" to --oxide-containing--.

Claim 2, column 39, line 50, change "stannic oxide and indic oxide" to --indic oxide and stannic oxide--.

Claim 6, column 39, line 63, after "has" delete "each".

Claim 11, column 40, line 44 after "contained" insert --in--.

Claim 12, column 40, line 48, after "contained insert --in--.

Claim 13, column 42, line 2, after "or" change "a" to --an--.

Claim 14, column 42, line 9 after "contained" insert --in--.

UNITED STATES PATENT AND TRADEMARK OFFICE

CERTIFICATE OF CORRECTION

PATENT NO. : 5,026,622

DATED : June 25, 1991

INVENTOR(S) : Taketoshi Yamada et al

It is certified that error appears in the above-identified patent and that said Letters Patent is hereby corrected as shown below:

Claim 15, column 42, line 13, after "contained" insert --in--.

Signed and Sealed this

Twenty-seventh Day of April, 1993

*Attest:*

MICHAEL K. KIRK

*Attesting Officer*

*Acting Commissioner of Patents and Trademarks*